US008176682B2

(12) United States Patent
Gaviglia

(10) Patent No.: US 8,176,682 B2
(45) Date of Patent: May 15, 2012

(54) DOUBLE PANEL DOOR AND DOUBLE FRAME PROVIDING RADIO FREQUENCY SHIELDING AND SOUNDPROOFING

(75) Inventor: John J. Gaviglia, Glenshaw, PA (US)

(73) Assignee: Gaven Industries, Inc., Saxonburg, PA (US)

( * ) Notice: Subject to any disclaimer, the term of this patent is extended or adjusted under 35 U.S.C. 154(b) by 0 days.

(21) Appl. No.: 12/880,528

(22) Filed: Sep. 13, 2010

(65) Prior Publication Data

US 2011/0061301 A1 Mar. 17, 2011

Related U.S. Application Data

(60) Provisional application No. 61/242,042, filed on Sep. 14, 2009.

(51) Int. Cl.
*E06B 5/20* (2006.01)

(52) U.S. Cl. ..... 49/501; 49/400; 52/784.1

(58) Field of Classification Search ..... 49/400, 49/401, 475.1, 477.1, 501, 504; 52/784.1, 52/784.11, 784.12, 784.13, 784.14, 784.15, 52/784.16

See application file for complete search history.

(56) References Cited

U.S. PATENT DOCUMENTS 3,051,260 A * 8/1962 Eckel ..... 181/287
4,371,175 A * 2/1983 Van Dyk, Jr. ..... 174/357
4,399,317 A * 8/1983 Van Dyk, Jr. ..... 174/364
4,507,520 A * 3/1985 Lindgren ..... 174/368
4,786,758 A * 11/1988 Zielinski ..... 174/369
4,924,969 A * 5/1990 L'Heureux ..... 181/290
4,982,053 A * 1/1991 Thornley et al. ..... 174/366
5,013,869 A 5/1991 Breithaupt
5,335,464 A * 8/1994 Vanesky et al. ..... 52/173.1
5,569,878 A * 10/1996 Zielinski ..... 174/364
5,777,279 A * 7/1998 Parker et al. ..... 181/287
6,112,496 A * 9/2000 Hugus et al. ..... 52/784.11
6,170,203 B1 1/2001 Schlapfer
6,519,889 B1 * 2/2003 Schlierbach et al. ..... 42/113
6,626,264 B1 9/2003 Christen
6,914,184 B1 * 7/2005 Lahita ..... 174/374
7,117,640 B2 10/2006 Hurzeler
7,246,681 B2 7/2007 Christen

* cited by examiner

*Primary Examiner* — Katherine W Mitchell
*Assistant Examiner* — Justin Rephann
(74) *Attorney, Agent, or Firm* — David G. Oberdick; Peter J. Borghetti

(57) ABSTRACT

Double paneled door assembly providing RF shielding and soundproofing through the use of two door panels, i.e., back door panel and front door panel, as well as respective back door frame and front door frame. The door panels and door frames are joined together by door pins and door pin bushing as well as frame pins and frame pin bushings, and the double door panels are mounted on the double frames by heavy duty hinges. The use of two door panels and frame panels with a volume of sealed air or other inert gas between the panels aids the RF shielding and soundproofing properties of the door. The bushings act as damping mechanisms to reduce transmission of vibration from the front side of the door assembly to the back side of the door assembly that will ultimately reduce waves permeating into an enclosed room or area.

18 Claims, 5 Drawing Sheets

DOUBLE PANEL DOOR AND DOUBLE FRAME PROVIDING RADIO FREQUENCY SHIELDING AND SOUNDPROOFING

CROSS-REFERENCE TO RELATED APPLICATION

This patent application is a non-provisional application that claims benefit of U.S. provisional application Ser. No. 61/242,042, titled DOUBLE PANEL DOOR PROVIDING RADIO FREQUENCY SHIELDING AND SOUND-PROOFING, filed on Sep. 14, 2009, and incorporated herein by reference.

FIELD OF THE INVENTION

This invention relates to a door providing radio frequency ("RF") shielding and soundproofing, and more particularly to a door which combines and improves the RF attenuation and soundproofing characteristics of the enclosed room/area.

BACKGROUND OF THE INVENTION

Developments continue to be made in RF shielding and RF shielded rooms for research, medical, military and other government uses. Enclosures with RF shielding, in some cases, also require soundproofing or acoustic insulation in order to protect against the transmission of sound from either within or outside of the shielded enclosure.

An important feature of RF shielded rooms is the door. For the door, RF and acoustic shielding occurs around the perimeter of the door, i.e., at the seal, and also through the door panels. For acoustic purposes, in particular, control of the passage of sound waves focuses on the door seal as well as on the mechanical door system, that is, on controlling and preventing the passage of sound waves through the air and also by vibration through materials. The present invention improves on both characteristics.

In addition to providing RF shielding and soundproofing, the door must also be functional. In addition, past efforts and designs have shown that the RF and soundproofing seals must be designed in such a manner that they do not wear and break through use.

SUMMARY OF THE INVENTION

The present invention includes a double paneled door that provides RF shielding and soundproofing through the use of two door panels, i.e., back door leaf or panel and front door leaf or panel, as well as respective back door frame and front door frame. The door panels and door frames are joined together by door pins and door pin bushing as well as frame pins and frame pin bushings. The double door panels are mounted on the double frames by heavy duty hinges and hinge shims. The use of two door panels and frame panels with a volume of air or other inert gas between the panels aids the RF shielding and soundproofing properties of the door in several respects as follows. The bushings act as damping mechanisms to reduce transmission of vibration from one side of the door assembly to the other side of the door assembly that will ultimately permeate into or out of the enclosed room or area.

DETAILED DESCRIPTION OF THE INVENTION

Figure 1:
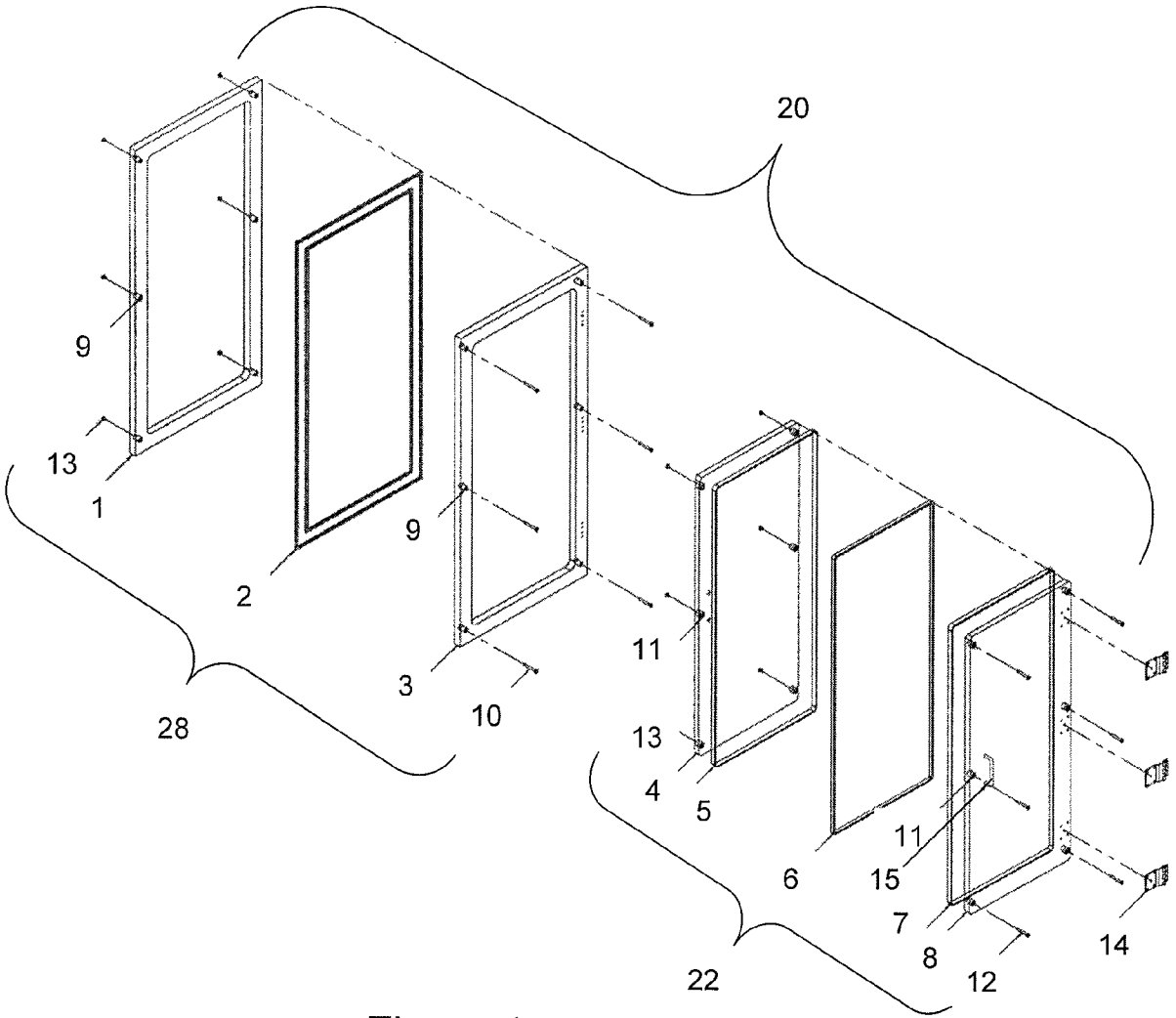
FIG. 1 is an exploded isometric view of the double paneled door frame and door of the present invention.

The present invention includes a combination of mechanical isolation systems to shield RF signal and dampen sound waves. Mechanical isolation can be accomplished by many mechanisms, devices, and techniques. Mechanical isolation mechanisms disclosed herein are for illustration purposes and not meant to limit the invention to any particular embodiment. Dampen means, for this application, a reduction of the amplitude of oscillations or waves. Damping means, for this application, a dissipation of energy in a mechanical system whose free oscillations decrease with time resulting in a decrease in its amplitude of vibration. Dampening means, for this application, to soundproof. Damped means, for this application, to decrease the amplitude of an oscillating system.

Referring now to the drawings and particularly to FIGS. 1, 2, and 3A-B, the present invention includes double paneled door assembly 20 that provides RF shielding and soundproofing through the use of door 22 with two door panels, i.e., back door leaf or panel 4 and front door leaf or panel 8, as well as respective frame 28 with back door frame 1 and front door frame 3. Door panels 4, 8 and door frames 1, 3 are joined together by door pins 12, pin bolts 13, and door pin bushing 11 as well as frame pins 10 and frame pin bushings 9, and double door panels 4, 8 are mounted on double frames 1, 3 by heavy duty hinges 14 and hinge shims. The use of two door panels 4, 8 and frame panels 1, 3 with a volume of air 34, 27, respectively, or other inert gas between the panels aids the RF shielding and soundproofing properties of the door in several respects as follows. Handle 15 is positioned on both sides of door 22 for opening and closing.

As discussed above, one embodiment of the present invention uses door assembly 20 with door 22 of two door panels 4, 8 and frame 28 of two frame panels 1, 3 connected by hinges 14 that create mechanical isolation in door assembly 20 and therefore deaden sound waves that attempt to pass or transmit, by vibration, through door assembly 20. The mounting system for door panels 4, 8 and frames 1, 3 (i.e., the pins 10, 12 and bushings 9, 11) provide a method for positive alignment of the two door panels 4, 8 and door frames 1, 3 for proper operation and to afford the required mechanical isolation for enhanced sound attenuation. The two door panels 4, 8 and the two frames 1, 3 can move freely and acoustically independently axially on the pins 10, 12.

Figure 3A:
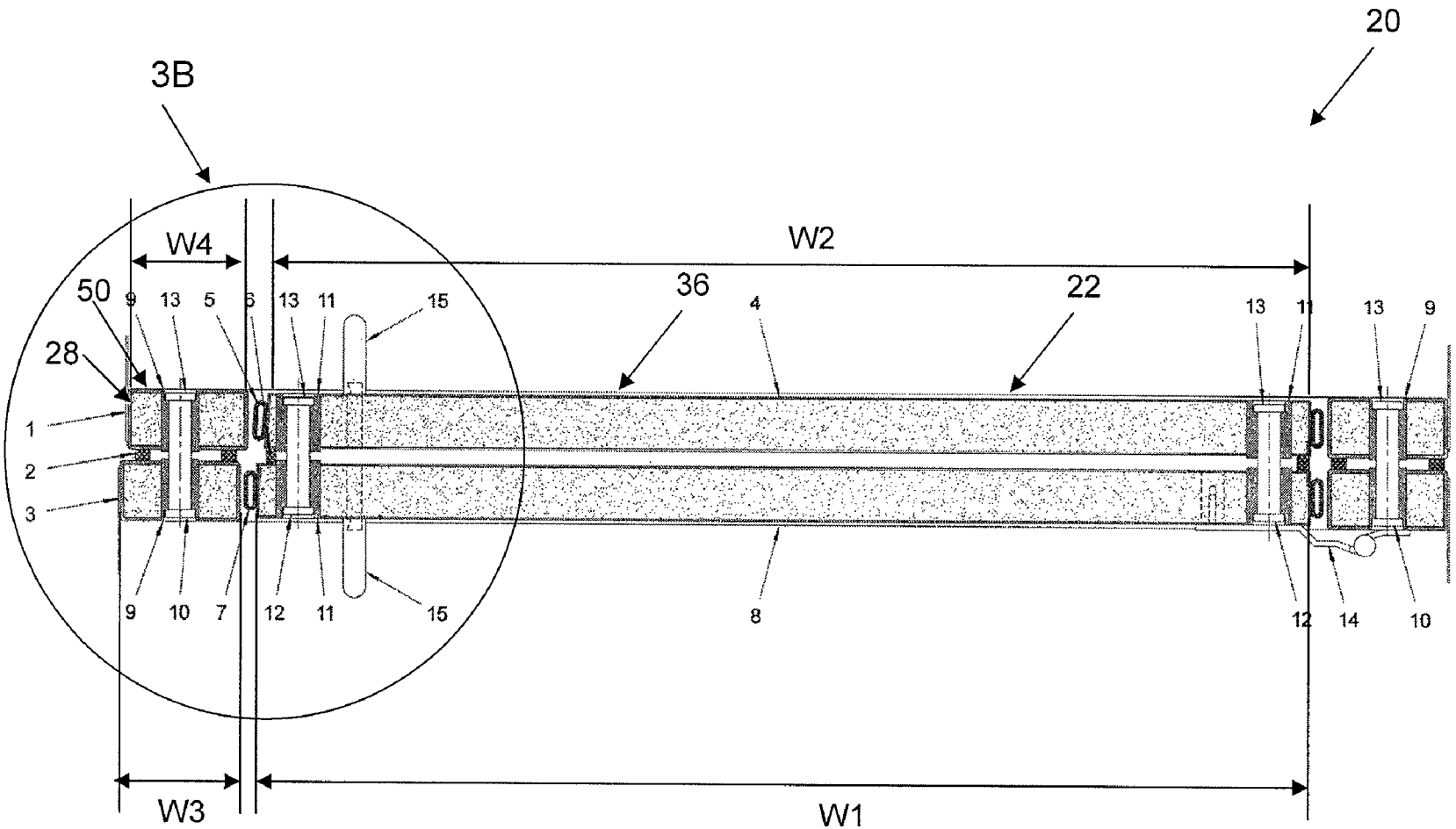
FIG. 3A is a horizontal cross-sectional view of the present invention as shown in FIG. 2.
Figure 3B:
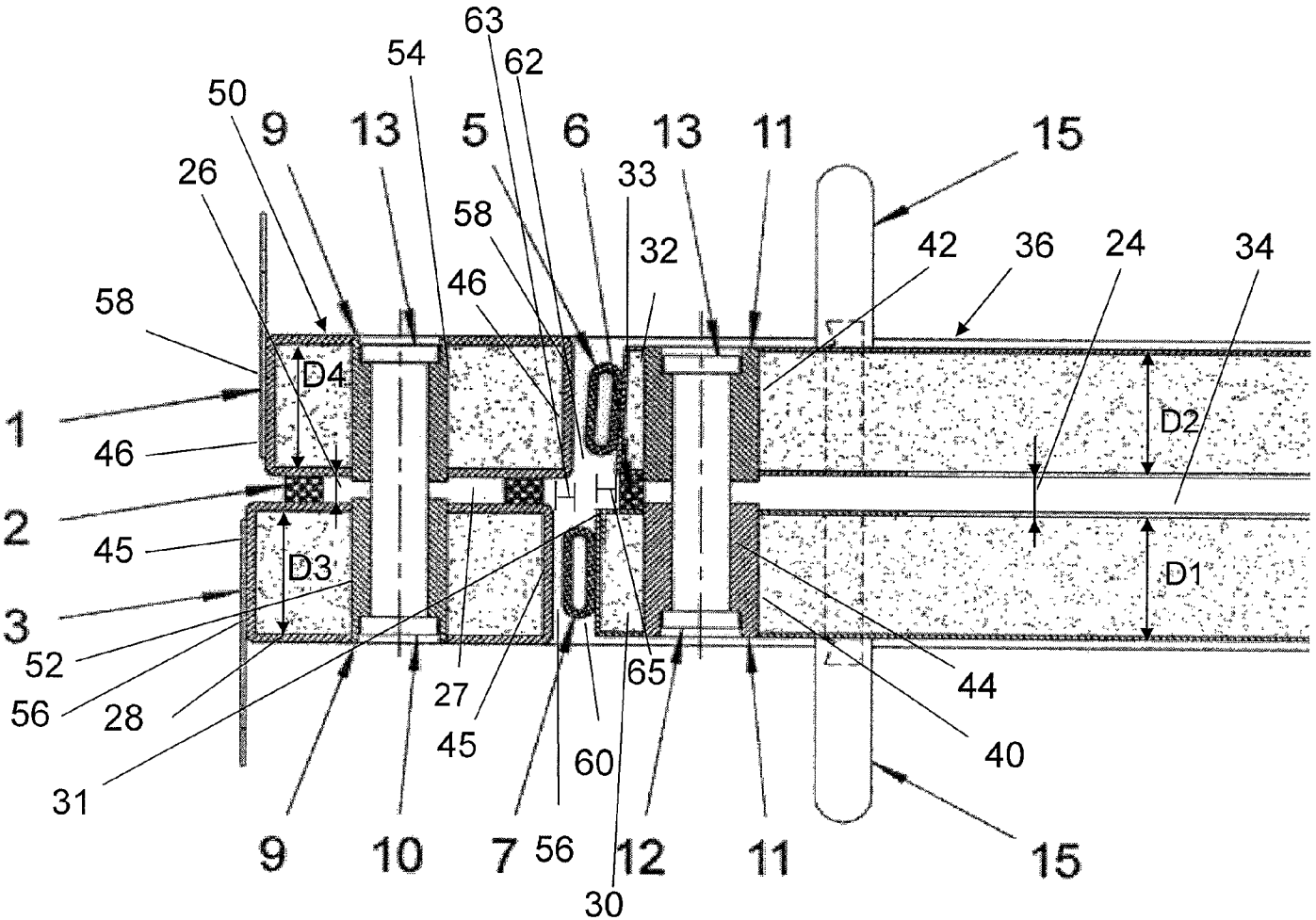
FIG. 3B is a magnified view of three layer insulation structure of the door and frame as shown in FIG. 3A.
Figure 4B:
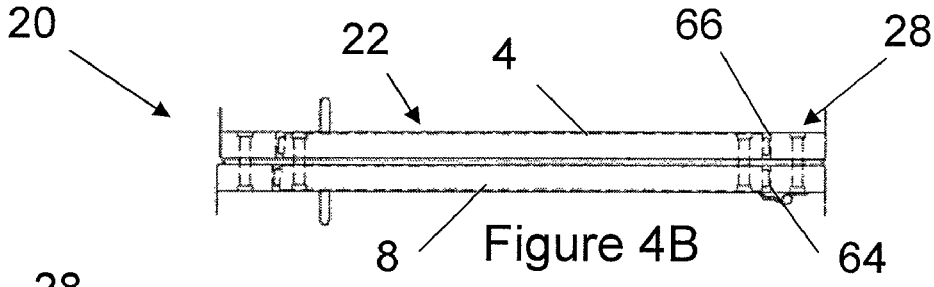
FIGS. 4*a-b* are front and top views of another alternative embodiment of the present invention illustrating an air inlet for inflatable door perimeter seals.
Figure 4A:
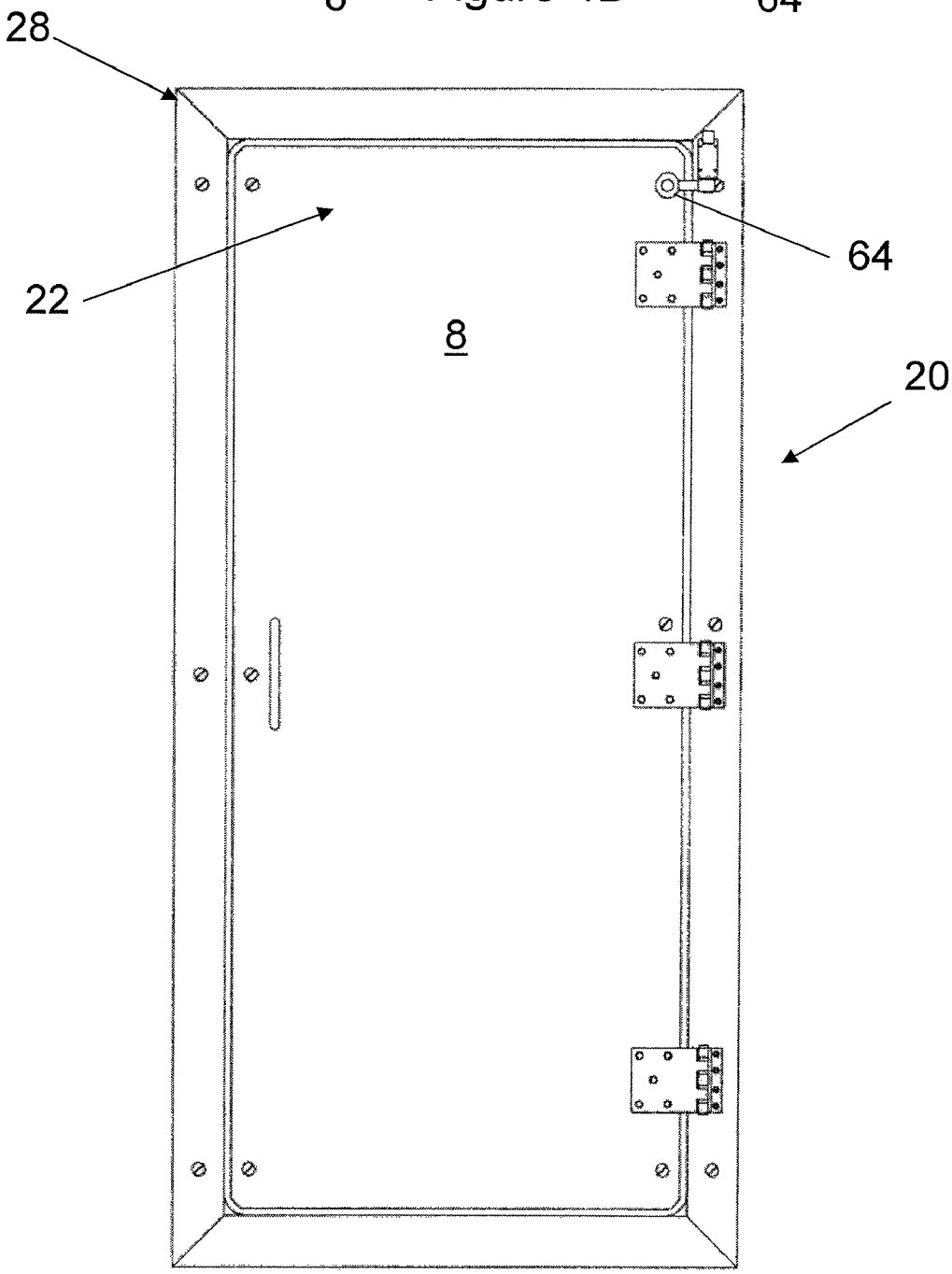

Now turning to FIGS. 3A-B, door 22 includes front door panel 8, back door panel 4, and pliable seal 6 (such as acoustical foam tape) disposed between front door panel 8 and back door panel 4 to form a substantially air tight barrier along perimeters 30, 32 of front door panel 8 and back door panel 4, respectively. A plurality of pins 12 and a plurality of bushing 11 operably connect front door panel 8 to back door panel 4 to set a gap 24 between front door panel 8 and back door panel 4 such that front door panel 8 and back door panel 4 are not in direct contact. This configuration forms an air or gas volume 34 between front door panel 8, back door panel 4, and pliable seal 6 to define a door three layer insulating structure or soundwave dampening mechanism 36. Soundwaves will be dampened as waves pass through each layer of insulating structure: door panel (4 or 8), gas volume 34, door panel (8 or 4).

A mechanical damping mechanism of the present invention is the interaction of the pins/bushing with the door panels as illustrated in FIG. 3B. Bushings 11 are in interference fit contact with holes 40, 42 in front door panel 8 and back door panel 4, respectively. Pins 12 can be press fit (as shown in FIGS. 3A-B) into bushings 11 from either front door panel 8 or back door panel 4 through bore 44 of bushing 11. Pins 12 are made of resilient material (such as a polyoxymethylene made by DuPont® under the trade name Delrin®) to reduce vibration transmission through the pins 12 between front door panel 8 and back door panel 4. Bushings 11 can be made of a material harder than pins 12 (such as 304 stainless steel) to prevent corrosion that would increase the surface friction between the pin 12 (a softer material) and the bushing 11 (a harder material). Bushings 11 allow independent relative motion between front door panel 8 and back door panel 4 that facilitates the damping of energy such as RF and sound waves. As illustrated in FIGS. 1-4, pins 12 secure front door panel 8 and back door panel 4 together leaving outer perimeter edges 31, 33, as free ends not constrained by a conventional outer door shell. Since outer perimeter edges 31, 33 are free, the mechanical isolation of environmentally (inside or outside the enclosure or room) induced waves are focused or directed through bushings 11 and, ultimately, through pins 12 to the opposing bushing 11, where it is further damped before transmission of energy or waves into an adjacent door panel.

Door frame 28 has a similar structure as door 22 described above. Door frame 28 includes front frame panel 3, back frame panel 1, and pliable seal 2 (such as acoustical foam tape) disposed between front frame panel 3 and back frame panel 1 to form a substantially air tight barrier along perimeters 45, 46 of front frame panel 3 and back frame panel 1, respectively. A plurality of pins 10 and a plurality of bushing 9 operably connect front frame panel 3 to back frame panel 1 to set gap 26 between front frame panel 3 and back frame panel 1, such that front frame panel 3 and back frame panel 1 are not in direct contact. This configuration forms air volume 27 between front frame panel 3, back frame panel 1, and pliable seal 2 to define a frame three layer insulating structure or soundwave dampening mechanism 50. Sound waves will be dampened as waves pass through each layer of insulating structure: frame panel (1 or 3), gas volume 27, frame panel (3 or 1).

Another mechanical damping mechanism of the present invention is the interaction of the pins/bushing with the frame panels. Bushings 9 are in interference fit contact with holes 52, 54 in front frame panel 3 and back frame panel 1, respectively. Pins 10 can be press fit (as shown in FIGS. 3A-B) into bushings 9 from either front frame panel 3 or back frame panel 1 through bore 52 of bushing 9. Pins 10 are made of resilient material (such as a polyoxymethylene made by DuPont® under the trade name Delrin®) to reduce vibration transmission through the pins 10 between front door panel 3 and back door panel 1. Bushings 9 can be made of a material harder than pins 10 (such as 304 stainless steel) to prevent corrosion that would increase the surface friction between the pin 10 (a softer material) and the bushing 9 (a harder material). Bushings 9 allow independent relative motion between front frame panel 3 and the back frame panel 1 that facilitates the damping of energy such as RF and sound waves. As illustrated in FIGS. 1-4, pins 10 secure front frame panel 3 and back frame panel 1 together leaving outer perimeter edges 56, 58, as free ends not constrained by a conventional outer shell. Since outer perimeter edges 56, 58 are free, the mechanical isolation of environmentally (inside or outside the enclosure or room) induced waves are focused or directed through bushings 9 and, ultimately, through pins 10 to the opposing bushing 9, where it is further dampened before transmission of energy or waves into an adjacent door panel.

A further embodiment of the present invention includes front seal 7 disposed on outer edge 31 of front door panel 8 adjacent to outer edge 56 of front frame panel 3 and back seal 5 disposed on outer edge 33 of back door panel 4 adjacent to outer edge 58 of back frame panel 1 when door 22 is in a closed position (as shown in FIG. 3A). The illustrations of seals 5, 7 in FIGS. 3A-B are representations of inflatable seals of a conventional air seal system. Alternative non-inflatable seals can replace inflatable seals 5, 7 such that frame gap 60, 62 are closed or sealed when door 22 is closed and not allowing air infiltration from either side of door assembly 20.

The above described panel attachment arrangement allows for different size panels to be assembled. As shown in FIGS. 3A-B, front door panel 8 has a larger width W1 than W2 of back door panel 4 to create an offset 65, as well as depths D1, D2, respectively. Also, frame panels 1, 3 can be of different widths (W3, W4) and depths (D3, D4) or arranged differently (e.g., offset 63) to meet customer specifications.

In addition, soundproofing is provided by filler material that is placed inside of the door panels 4, 8 and frames 1, 3. For the frames, filler material can be sand or lead shot, although other materials may be used. For the door, filler material may include rubber, plywood, lead, gravel, fiberglass, particle board, neoprene, polyethylene, masonite, MDF board, various adhesives and other similar materials. Such filler materials act to further deaden or dampen sound waves as they pass through the door and frame members.

Figure 2:
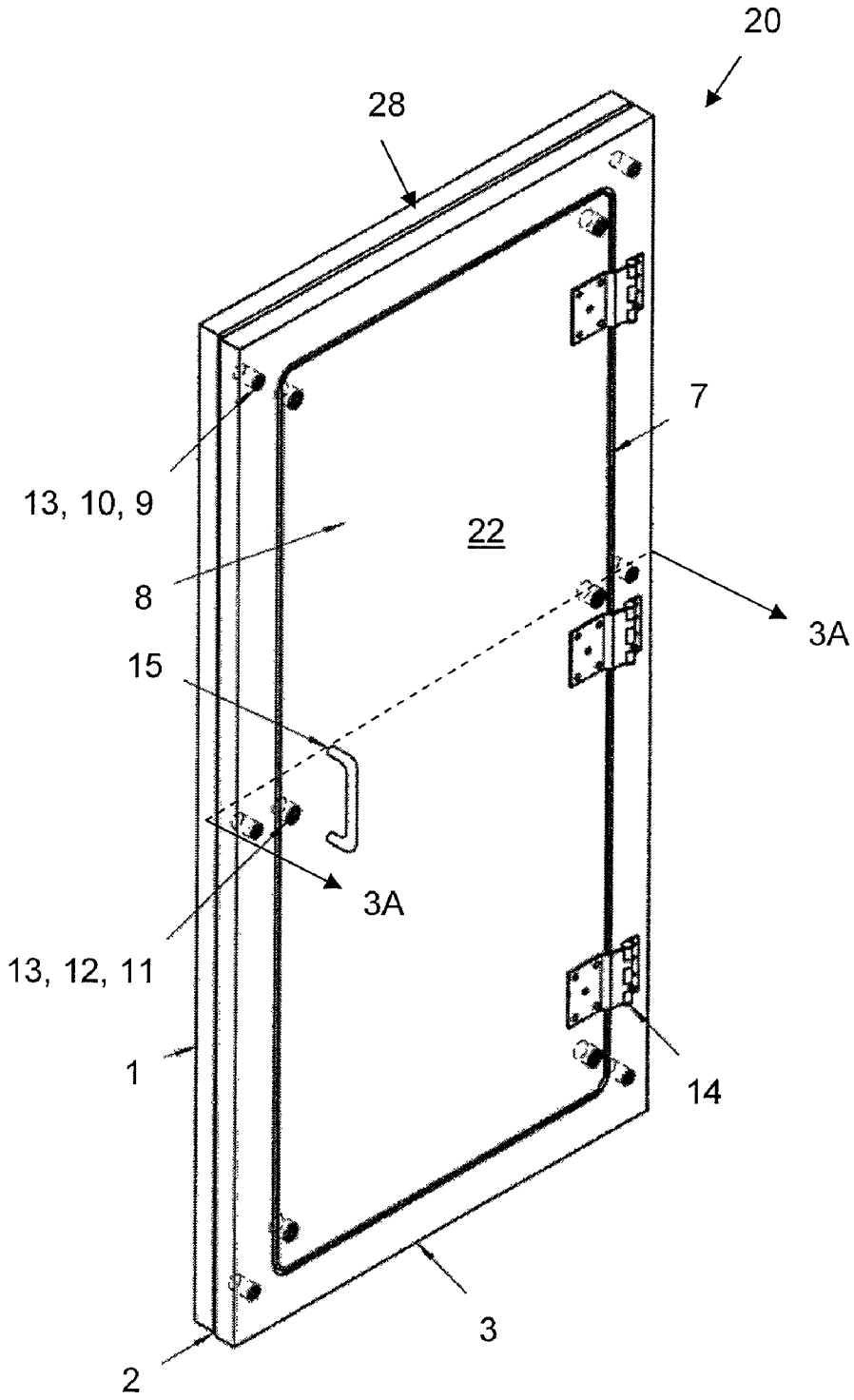
FIG. 2 is an isometric view of the assembled double paneled door frame and door of FIG. 1.

As shown in FIGS. 1 and 2, door panels 4, 8 and frame panels 1, 3 of the present invention are designed to be assembled on site, with filler material added to frame panels 1, 3 before or after being transported to a site and assembled. The door panels 4, 8 and frame panels 1, 3 are moved in component parts to the assembly site, put together, and then the filler materials are added to the frame panels 1, 3 (for the doors, filler material can be added before transport). This avoids having to carry and assemble heavy frame panels 1, 3. Frame filler/drain holes can be located anywhere at the head of the door frame. If the material in the frame needs to be drained, the frame is turned upside down and the material exits through the filler hole.

The material composition of the frame panels 1, 3 and door panels 4, 8 is typically stainless steel, but can be any suitable material. The dimensions of the door and the frame can also be determined by customer specifications. In particular, door and frame thickness or depths can vary depending upon the required level of sound attenuation.

One embodiment of the present invention provides for RF attenuation of greater than 120 dB through 1 GHz and greater than 85 db through 10 GHz. The present invention has a sound transmission class rating of about 45 to about 65.

As discussed above, the present invention can include an inflatable RF seal 5 and an inflatable acoustic seal 7, both with pneumatic sealing, on the same door system. Specifically, an RF seal 5 is placed around the perimeter outer edge 33 of the door panel 4. Seal 5 can be adhered to the door panel 4 by an adhesive such as glue, epoxy, tape, foam or other adhesive. A pneumatic acoustic seal 7 is mechanically attached around the perimeter 31 of the door panel 8 and can be easily replaced in one piece. Any conventional inflatable seal pneumatic system can be used with the present invention. One embodiment of the present invention illustrated in FIGS. 4A-B includes air inlets 64, 66 in front door panel 8 and back door panel 4, respectively.

The above discussed features reduce radio frequency waves and sound waves as the waves travel through the door three layer insulating structure and the door frame three layer insulating structure.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A door assembly comprising:

two door panels in parallel orientation only joined together by door panel bushings and door panel pins, wherein the door panel bushings are disposed in a first door panel and a second door panel of the two door panels, wherein the door panel pins connect the door panel bushings positioned adjacent thereto, wherein the door panel bushings disposed in the first door panel dampen energy from the first door panel prior to transmission of energy through the door panel pins to the door panel bushings in the second door panel for further damping of energy prior to transmission of energy into the second door panel, wherein the door panel bushings and door panel pins allow independent relative motion of the two door panels to reduce energy transmission therebetween, wherein the two door panels are not enclosed within an outer shell;

two frames in parallel orientation only joined together by frame bushings and frame pins, wherein the frame bushings are disposed in a first frame and a second frame of the two frames, wherein the frame pins connect the frame bushings positioned adjacent thereto, wherein the frame bushings disposed in the first frame dampen energy from the first frame prior to transmission of energy through the frame pins to the frame bushings in the second frame for further damping of energy prior to transmission of energy into the second frame, wherein the frame bushings and frame pins allow independent relative motion of the two frames to reduce energy transmission there between; and a plurality of hinges operably connecting the two door panels and one frame of the two frames.

2. The door assembly according to claim 1, further comprises a volume of inert gas between the two door panels to dampen soundwaves transmitted between the two door panels.

3. The door assembly according to claim 1, further comprises a volume of inert gas between the two frames to dampen soundwaves transmitted between the two frames.

4. The door assembly according to claim 2, wherein the volume of inert gas is a sealed.

5. The door assembly according to claim 3, wherein the volume of inert gas is a sealed.

6. The door assembly according to claim 1, further comprises seals disposed between the two door panels and the two frames to provide infiltration of RF signals and sound waves therebetween.

7. The door assembly according to claim 6, wherein the seals are inflatable.

8. The door assembly according to claim 1, wherein a width of a first door panel of the two door panels is less than a width of a second door panel of the two door panels, wherein the width of the first door panel is a distance between a first side edge of the first door panel and an opposing second side edge of the first door panel, wherein the width of the second door panel is a distance between a first side edge of the second door panel and an opposing second side edge of the second door panel, wherein the first side edge of the first door panel is aligned with the first side edge of the second door panel to form an aligned door edge positioned adjacent to the plurality of hinges, and the opposing second side edge of the first door panel is not aligned with the opposing second side edge of the second door panel to form an offset door edge of the two doors.

9. The door assembly according to claim 8, wherein the two frames are offset relative to widths to accommodate the offset door edge of the two door panels.

10. A door assembly comprising:

a door comprising, a front door panel, a back door panel, and a pliable seal disposed between the front door panel and the back door panel to form a substantially air tight barrier along perimeters of the front door panel and the back door panel, a plurality of pins and a plurality of bushings operably connect the front door panel to the back door panel to set a gap therebetween such that the front door panel and the back door panel are not in direct contact, wherein an air volume is formed between the front door panel, the back door panel, and the pliable seal to define a three layer insulating structure, wherein the plurality of bushings are made of pliable material to reduce vibration transmission through the plurality of pins between the front door panel and the back door panel and to allow independent relative motion between the front door panel and the back door panel, wherein the front door panel and the back door panel are not enclosed within an outer shell;

a door frame comprising, a front frame panel, a back frame panel, and a pliable seal disposed between the front frame panel and the back frame panel to form a substantially air tight barrier along perimeters of the front frame panel and the back frame panel, a plurality of pins and a plurality of bushings operably connect the front frame panel to the back frame panel to set a gap therebetween such that the front frame panel and the back frame panel are not in direct contact, wherein an air volume is formed between the front frame panel, the back frame panel, and the pliable seal to define a three layer insulating structure, wherein the plurality of bushings are made of pliable material to reduce vibration transmission through the plurality of pins between the front frame panel and the back frame panel and to allow independent relative motion between the front frame panel and the back frame panel, wherein the front frame panel and the back frame panel are not enclosed within an outer shell;

a front seal disposed on an outer edge of the front door panel adjacent to an outer edge of the front frame panel when the door is in a closed position;

a back seal disposed on an outer edge of the back door panel adjacent to an outer edge of the back frame panel when the door is in the closed position; and a plurality of hinges operably connecting the door to the door frame, whereby radio frequency waves and sound waves are reduced as the waves travel through the door three layer insulating structure and the door frame three layer insulating structure.

11. The door assembly according to claim 10, wherein the front door panel and the back door panel are hollow to receive an insulating material.

12. The door assembly according to claim 10, wherein the insulating material is selected from a group consisting of rubber, plywood, lead, gravel, fiberglass, particle board, neoprene, polyethylene, masonite, MDF board, various adhesives and other similar materials.

13. The door assembly according to claim 10, wherein the front seal and the back seal are inflatable.

14. The door assembly according to claim 10, wherein a width of the front door panel is a different dimension than a width of the back door panel.

15. The door assembly according to claim 10, wherein outer perimeter edges the front door panel, the back door panel, the front frame panel, and back frame panel are free edges allowing unconstrained outward movement of the outer perimeter edges.

16. The door assembly according to claim 10, wherein the front frame panel and the back frame panel are hollow to receive an insulating material.

17. The door assembly according to claim 16, wherein the frame panel insulating material is selected from a group consisting of sand and lead shot.

18. The door assembly according to claim 16, wherein the front frame panel and the back frame panel include at least one hole to receive the insulating material allowing for filling of the insulating material.

* * * * *